US005224997A

United States Patent [19]

Grilloud et al.

[11] Patent Number: 5,224,997

[45] Date of Patent: Jul. 6, 1993

[54] APPARATUS FOR PRODUCING A SURFACE LAYER ON A METALLIC WORKPIECE

[75] Inventors: Roger Grilloud, Grandson; Denis Gonseth, Founex; Roger Dekumbis, Zurich, all of Switzerland

[73] Assignees: Sulzer Brothers Limited, Winterthur; Amysa-Yverdon, S.A., Yverdon-Les-Bains, both of Switzerland

[21] Appl. No.: 710,815

[22] Filed: Jun. 5, 1991

[30] Foreign Application Priority Data

Jun. 13, 1990 [CH] Switzerland ..... 1992/90

[51] Int. Cl.[5] ..... B23K 26/00

[52] U.S. Cl. ..... 118/667; 118/641; 219/121.65

[58] Field of Search ..... 118/69, 641, 667; 219/121.65, 121.66, 121.83; 427/53.1, 325

[56] References Cited

U.S. PATENT DOCUMENTS 4,701,572 10/1987 Cheung ..... 219/121.65
4,780,590 10/1988 Griner et al. ..... 219/121.65
5,015,492 5/1991 Venkatesan et al. ..... 118/641

FOREIGN PATENT DOCUMENTS 0190378 8/1986 European Pat. Off. .
2811400 9/1979 Fed. Rep. of Germany .
2256962 8/1975 France .
0674650 6/1990 Switzerland .

OTHER PUBLICATIONS

Patent Abstracts of Japan, vol. 8, No. 62 (C-215) (1499); Mar. 1984 [58-216756].
Patent Abstracts of Japen, vol. 8, No. 199 (C-242) (1636); Set. 1984 [59-89712].
Patent Abstracts of Japan, vol. 12, No. 491 (C-554) (3338) Dec. 1988 [63-203759].
Patent Abstracts of Japan, vol. 13, No. 151 (C-584) (3499) Apr. 1989 [63-307285].
Patent Abstracts of Japan, vol. 14, No. 326 (C-740) (4269) Jul. 1990 [2-118083].

*Primary Examiner*—W. Gary Jones
*Assistant Examiner*—Charles K. Friedman
*Attorney, Agent, or Firm*—Kenyon & Kenyon

[57] ABSTRACT

The surface of a workpiece is provided with a surface layer. Initially, the workpiece is inductively heated by a HF/MF generator to a first temperature and subsequently heated further by a laser beam with coating material being applied to the region of the laser beam in an amount sufficient to form a surface layer on the workpiece. The generator and the laser source are able to operate simultaneously to effect a high quality surface layer of relatively thin thickness.

6 Claims, 1 Drawing Sheet

APPARATUS FOR PRODUCING A SURFACE LAYER ON A METALLIC WORKPIECE

BACKGROUND OF THE INVENTION

This invention relates to a method and apparatus for producing a surface layer on a metallic workpiece.

For the most various reasons, workpieces have been provided wholly or partially with surface layers. For example, surface layers have been provided at places on workpieces which are particularly heavily loaded thermally, chemically or mechanically. These layers may moreover be produced by alteration of the structure of the surface regions of a workpiece, e.g., by hardening by, say, heat treatment, or by the incorporation of foreign substances. Surface layers are also generated by the application of actual surface layers, such as by melting them on or by galvanic surface treatment.

In the case of coated workpieces which are subjected, e.g., to alternating thermal loading, the life of surface layers suitable in themselves is inadequate for certain applications. For example, the surface layer or parts thereof may loosen from the workpiece. In other cases, cracks may form in the surface layer which lead to a breakdown of the surface layer and also of the workpiece.

By way of example, European Patent Application 0 190 378 describes a method for surface-alloying metal with a high-density energy beam and an alloy steel. In one described embodiment, a second heat source comprising a burner or an induction heater is disposed in front of and/or behind the irradiation area of the high-density energy beam. This second heat source provides a supplementary heat source for decreasing the energy of the high-density beam and/or for enhancing the working ability and is intended to prevent thermal cracks. However, such a technique still allows the overall workpiece to be subjected to alternating thermal loading. That is to say, while the area under the influence of the second heat source and high density energy beam, i.e. a laser beam, is significantly heated, the adjacent areas of the workpiece are not. Thus, there is an uneven temperature over the working area of the workpiece. Hence, residual stresses occur during the thermal treatment of workpieces. These residual stresses, in turn, may result in deformations such as localized buckling, within the workpiece and in the surface layer thereon.

Accordingly, it is an object of the invention to improve the quality of a surface layer on a workpiece.

It is another object of the invention to provide a relatively simple technique for forming high quality surface layers on a workpiece.

It is another object of the invention to form relatively thin surface layers on a workpiece with minimal melting of the workpiece.

SUMMARY OF THE INVENTION

Briefly, the invention provides a method and apparatus for producing a surface layer on a metallic workpiece.

In accordance with the method, at least one part of a metallic workpiece to be coated is inductively heated through a first range of temperatures and thereafter a laser beam is directed onto a limited surface heated part in order to melt the surface for generating a surface layer on a workpiece.

In one embodiment, the laser beam may be used to directly heat the surface of the workpiece followed by a rapid cool down of the workpiece in order to form a surface layer therein.

In another embodiment, a coating material is fed into a region of the laser beam striking the surface of the heated part of the workpiece in an amount sufficient to effect fusing of the coating material with the workpiece surface in order to form a surface layer thereat.

The apparatus includes a high-frequency/medium-frequency generator, an inductive coil electrically connected to the generator for inductively heating at least a part of a metallic workpiece to be coated through a first range of temperature and a laser source for directing a laser beam onto a limited surface of the heated part of the workpiece for melting of said surface.

In the embodiment where the surface layer is formed by a coating material, a suitable means is provided for feeding the coating material into the region of the laser beam for fusion with the workpiece surface.

By the inductive high-frequency/medium-frequency generator, it is possible to heat the workpiece to which the surface layer is to be applied, up to a well defined temperature and—what is of importance for the quality of the surface layer—to maintain this temperature precisely even during the production of the surface layer. The inductive preheat temperature may be maintained without problem exactly within $\pm 10°$ C. The improved quality is, inter alia, to be attributed to the fact that the temperature difference between the workpiece and the fusion region, that is, the region where the surface layer is generated continuously by the laser beam, may first be chosen and secondly be kept relatively low, and thirdly even during the production of the surface layer may be well maintained. The character of the surface layer, in particular its thickness, surface, structure, crystalline structure, ductility, hardness, etc. thereby becomes more uniform and therefore the surface layer becomes quite generally better. By the method, thinner surface layers may also be produced.

The method thus makes it possible to position the work area of the laser beam directly into the center of the inductively heated area or near the center of the inductively heated area. The inductive heating permits, over and above that, the production of an essentially equal temperature over relatively large areas of the workpiece, that is, a homogeneous temperature field. This serves to keep the residual stress which may occur during thermotreatment at extremely low values. The consequence of this is that deformations of the treated workpiece, the so-called buckling remains minor or practically fail to materialize at all.

Basically, the following possibilities exist of producing surface layers: By hardening in the solid state, in which in principle the workpiece is heated and thereupon rapidly cooled down; through fusion and restructuring of the material of the workpiece; through fusion and incorporation of foreign material, i.e., alloying the surface layer of the workpiece; through melting on a layer of a material which differs from that of the workpiece, the surface layer and workpiece being connected only in a thin fusion region. Moreover, the cooling down process has in the case of all kinds of production of surface layers, an influence upon their properties.

In the case of surface layers of a material differing from that of the workpiece, the coefficient of thermal expansion of the layer material may be chosen to be lower than that of the material of the workpiece. Because of the exact choice of temperature possible in the coating process, the temperature of the workpiece during coating may be chosen to be higher than the operating temperature foreseen for the workpiece so that, at operating temperature, the surface layer experiences in operation a definite compressive force which is exerted upon and transmitted to the surface layer from the workpiece. Inherent compressive stresses of that kind in the surface layer oppose crackformation, material fatigue and also corrosion of the part and in particular of the surface layer. Thus, the life and quality of the part and in particular of the surface layer are improved. This is the case, for example, with a stellite 6 layer on a workpiece of X2 CrNiMo 18 12 (chrome-nickel-molybdenum) stainless steel.

The possibility of rapid inductive preheating of the workpiece through a first range of temperature up to a discretionary first temperature also reduces the troublesome processes of oxidation on the workpiece surface during coating or avoids these altogether if the heating is effected under protective gas.

Through appropriate adaptation of the induction coil connected to the HF/MF generator, the inductive heating permits very different temperature profiles over the whole workpiece. This enables the distortion and deformation of the workpiece to be reduced and also allows the progress of the hardening over the surface layer to be kept uniform. Moreover, annealing, i.e., the resoftening of parts of a hardened workpiece or surface may be prevented or influenced through the choice of the inductive heating profile, possibly in combination with a cooling process. Then, on the surface which, for example, may be heated inductively to a temperature of 800° C., the surface layer may be melted on by the laser source at a temperature of 1800° C.

The HF/MF generator which preferably works in the frequency range from 0.5 kHz to 1 MHz in the power range from 5 to some tens of kW has as heating, above all, a depth or volume effect whilst the superimposed heating by the laser source has, above all, a point by point surface action, that is, in the region of the preheated surface, where the actual surface layer is generated at still higher temperature by melting on foreign material or merely the uppermost layers of the workpiece to be coated. In that case, the layer material, for example, may be blown in powder form and by protective gas as the medium of conveyance into the region of the laser beam striking the surface of the workpiece. There the powder is fused and blended with the thinnest and smallest fused part possible of the surface of the workpiece. For example, by the method, thin surface layers may be generated in the range of thickness from 0.2–0.4 millimeters (mm).

In order not to overheat certain regions of workpieces and/or to keep them within a certain temperature range, individual regions of the workpiece and/or of the surface layer may be cooled by a cooling means which works with, e.g., air, oil, water or some other cooling medium. By cooling, it is also possible to keep the character of the surface layer of a workpiece constantly improved. The character of a surface is in many cases dependent upon cooling processes which may be maintained better and more exactly by a cooling device. By the cooling means, it is possible both to avoid overheating and to improve, i.e., to maintain more exactly the time slope of the cooling process.

Under the method, the workpiece to be provided with the surface layer or parts of the workpiece, are heated by the inductive HF/MF generator to a first temperature. By the laser source limited regions of the heated surface to be treated are further heated and the surface layer generated on the workpiece. The laser source and the HF/MF generator, allow the workpiece to be influenced by both simultaneously. Workpieces with surface layers generated according to the method exhibit a higher, i.e., an improved quality since the method allows and makes possible a clearly improved maintenance of the temperature time slope and also the temperature distribution in the workpiece.

BRIEF DESCRIPTION OF THE DRAWINGS

These and other objects and advantages of the invention will become more apparent from the following detailed description taken in conjunction with the accompanying drawing wherein.

DETAILED DESCRIPTION

Figure 1:
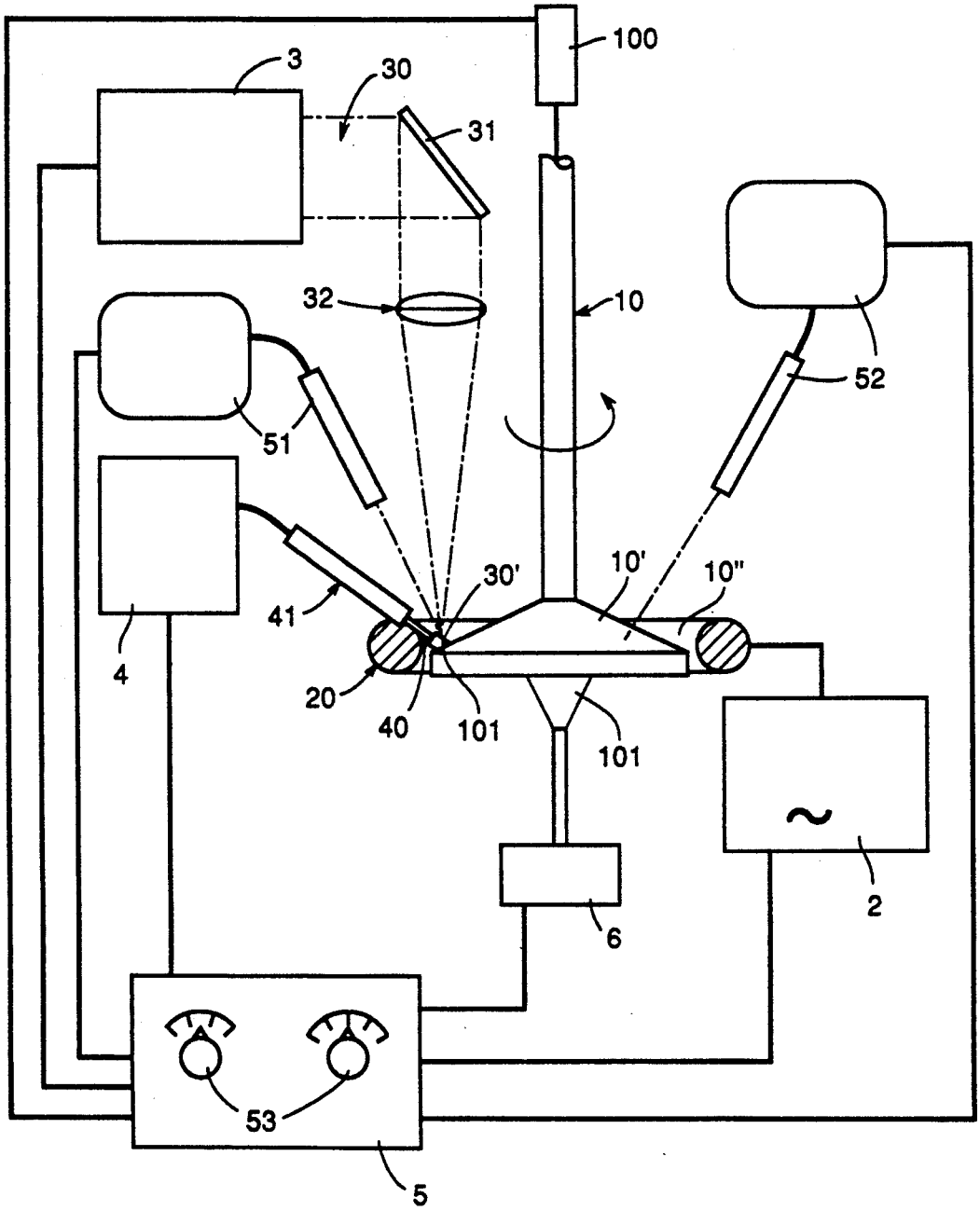
FIG. 1 schematically illustrates an apparatus constructed in accordance with the invention.

Referring to the drawing, in the simplest form, the apparatus for producing a surface layer 101 on a workpiece 10 includes a holding device for the workpiece 10, a HF or MF generator 2 (HF=high frequency; MF=medium frequency) with an induction coil 20 which together form essentially an inductive heating means, and a laser source 3 with a deflecting mirror 31 and optical system 32 for focusing a laser beam 30.

As shown, the workpiece 10 may, for example, be a valve for a combustion engine. The edge regions 10″ of the valve head 10′ which forms the annular sealing region in the valve seating are to be provided with a surface layer 101.

The inductive heating means functions to heat the entire workpiece edge region 10″, as indicated by the coil to being concentrically disposed about this workpiece 10 so as to envelop this edge region 10″ circumferentially. For example, the entire edge region 10″ is heated to a temperature of 800° C.

The laser beam 30 is focused by the deflecting mirror 31 and the optical focusing system 32 onto the working point 30′ of the edge region 10″ of the valve 10′ which is to be coated. That is, the beam 30 is directed onto a limited surface of the heated edge region 10″ to meet the surface thereat.

The surface layer 101 may, for example, be generated through mere fusion and restructuring of the workpiece (hardening) of regions of the valve head 10, or through application of a layer of another material, e.g., stellite. The stellite in powder form may, e.g., by means of a powder conveyor 4 with a powder nozzle 41 which generates a powder jet 40, be blown at the working point 30′ into the region of the laser beam 30. Conveyance of the powder may be effected by argon which simultaneously acts as protective gas about the heated surface during generation of the surface layer 101.

For the coating of axially symmetrical workpieces 10 and axially symmetrical surface layers 101, the workpiece 10 may be turned by means such as a turning mechanism 100. It would also be possible to move the working point 30′ of the laser beam 30 together with the powder jet 40 along the surface of the workpiece 10. It would again be conceivable to move all four, workpiece 10, laser beam 30, and powder jet 40 as well as the coil 20 or else just one or a number of them. This might confer advantages if, for example, complicated surface layer patterns have to be generated on workpieces with complicated contours.

In many applications, the quality of the surface layer is influenced by maintaining exact limits to the temperature of the workpiece 10 and the surface layer 101 in the region of the working point 30' of the laser beam 30. In just the same way, the cooling process may be decisive for the character and properties of the surface layer and the coated workpiece. For this purpose, the apparatus may include a control and regulating device 5 by which the HF/MF generator 2 heating power and also the power of the laser source 3 may be controlled and regulated. In the example shown, two temperature sensors 51, 52 are provided as control quantities which determine the temperature of the surface layer 101 in the region of the working point 30' of the laser 30 or respectively the surface temperature of the valve head 10'. The control and regulating device 5 may set the power of the HF/MF and/or the laser heating sources 2,3 to desired values which are predetermined, for example, at a temperature-desiredvalue transmitter 53.

For maintaining particular temperature profiles on the workpiece 10 or parts thereof, e.g., on the valve head 10', a cooling means 6, for example, may be provided which cools the valve head by a jet 60 of cooling fluid of, e.g., air, a protective gas or a liquid such as water. The temperatures might also be regulated, i.e., influenced by the speed of rotation of the turning mechanism 100 for the workpiece 10 and/or by the cooling fluid jet 60 being varied or respectively switched on and off. The control and regulating means 5 may be programmable within wide limits in order, depending upon the surface layer which is to be produced, to create other surface coating conditions. Thus, the apparatus may be constructed at the induction coil 20, the temperature sensors 51, 52, e.g., radiation pyrometers and the laser source 3 with the laser beam 30 are moved with respect to one another and/or to the workpiece 16 which in turn is likewise moved. The possible signal flow from the regulating and control device 5 is indicated in the diagrammatic Figure by arrows. All of these relative motions may likewise be determined by the regulating and control device 5.

The invention thus provides a relatively simple technique for forming relatively thin surface layers on metallic workpieces. In this respect, the surface layer is to be distinguished from an alloy layer which may be formed on a workpiece, for example, as described in European Patent Application 0190378. As described therein, the surface of a base metal is alloyed by means of a laser or electron beam which locally melts the surface of the base metal while additive material is delivered into the melted base metal. A distinguishing feature of a surface layer made in accordance with the above described process is the formation of a very thin fusion region between an applied surface layer and the workpiece.

The fusion region region between an applied surface layer and the workpiece is typically thinner than the surface layer itself and lies in most cases between two and twenty μm.

In the sense of this invention the term surface layer can either mean a layer of the basic material of a workpiece having a different structure or a layer of different material fused onto the original surface layer of the workpiece. Different structures of the surface layer can for instance be produced by defined fast and/or slow cooling.

What is claimed is:

1. An apparatus for producing a surface layer on a workpiece comprising:

a high-frequency/medium-frequency generator;

an inductive coil electrically connected to said generator for inductively heating at least a part of a metallic workpiece to be coated through a first range of temperature; and a laser source for directing a laser beam into a limited surface within said heated part of the workpiece for further heating and/or melting of said surface.

2. An apparatus as set forth in claim 1 which further comprises means for feeding a coating material into a region of said laser beam and said workpiece surface for fusion with said workpiece surface.

3. An apparatus as set forth in claim 2 which further comprises means for moving said workpiece relative to said laser beam.

4. An apparatus as set forth in claim 2 which further comprises means for determining the temperature of said workpiece during heating thereof.

5. An apparatus as set forth in claim 2 which further comprises means for cooling the workpiece during fusion of said surface layer thereon.

6. An apparatus as set forth in claim 2 which further comprises a programmable regulating and control device operatively connected to said generator and said laser source for controlling the heating of a workpiece and fusion of a surface layer thereon.

* * * * *

UNITED STATES PATENT AND TRADEMARK OFFICE

CERTIFICATE OF CORRECTION

PATENT NO. : 5,224,997

DATED : July 6, 1993

INVENTOR(S) : Guilloud et al.

It is certified that error appears in the above-identified patent and that said Letters Patent is hereby corrected as shown below:

Title page, item [75]
Please change the first inventor's name from "Roger Grilloud" to --Roger Guilloud--;

Column 3, line 9, change "crackformation" to --crack-formation--; and

Column 6, line 9, delete "region" second occurence.

Signed and Sealed this

Thirtieth Day of August, 1994

*Attest:*

*Attesting Officer*

Bruce Lehman

BRUCE LEHMAN

*Commissioner of Patents and Trademarks*